US010612271B2

(12) United States Patent
Farag et al.

(10) Patent No.: US 10,612,271 B2
(45) Date of Patent: Apr. 7, 2020

(54) REKEYABLE LOCK CYLINDER WITH ENHANCED TORQUE RESISTANCE

(71) Applicant: SPECTRUM BRANDS, INC., Middleton, WI (US)

(72) Inventors: Hanna Farag, Riverside, CA (US); Jack Zhang, Xiamen (CN); Mark S. Bloom, Lake Forest, CA (US); James Lin, Laguna Niguel, CA (US)

(73) Assignee: Spectrum Brands, Inc., Middleton, WI (US)

( * ) Notice: Subject to any disclaimer, the term of this patent is extended or adjusted under 35 U.S.C. 154(b) by 0 days.

(21) Appl. No.: 15/172,206

(22) Filed: Jun. 3, 2016

(65) Prior Publication Data

US 2016/0369527 A1 Dec. 22, 2016

Related U.S. Application Data

(60) Provisional application No. 62/180,339, filed on Jun. 16, 2015.

(51) Int. Cl.
*E05B 27/00* (2006.01)
*E05B 15/04* (2006.01)

(52) U.S. Cl.
CPC ..... *E05B 27/0082* (2013.01); *E05B 27/005* (2013.01); *E05B 27/0017* (2013.01); *E05B 27/0057* (2013.01)

(58) Field of Classification Search
CPC ..... E05B 27/0082; E05B 27/0017; E05B 27/0057; E05B 27/005; E05B 29/004; E05B 29/0066; E05B 15/04; E05B 27/0021; Y10T 70/7616; Y10T 70/7621
USPC ..... 70/337–343, 368, 382–385, 492–496
See application file for complete search history.

(56) References Cited

U.S. PATENT DOCUMENTS 1,965,336 A * 7/1934 Fitz Gerald ..... E05B 29/00 70/421
2,004,433 A * 6/1935 Fitz Gerald ..... E05B 29/00 70/419
2,024,441 A * 12/1935 Fitz Gerald ..... E05B 29/00 70/377
2,405,911 A * 8/1946 Swanson ..... E05B 29/00 70/495
2,426,104 A * 8/1947 Johnstone ..... E05B 27/0082 70/421

(Continued)

FOREIGN PATENT DOCUMENTS

JP 2011074613 A 4/2011
WO 2009008852 A1 1/2009

*Primary Examiner* — Lloyd A Gall
(74) *Attorney, Agent, or Firm* — Merchant & Gould P.C.

(57) ABSTRACT

A rekeyable lock cylinder with a cylinder body and a plug assembly. The lock cylinder includes a plurality of key followers and a corresponding plurality of racks disposed in the plug assembly. The lock cylinder includes, for example, a locking bar for blocking rotation of the plug assembly with respect to the cylinder body to prevent unlocking of the rekeyable lock cylinder with an unauthorized object. In some embodiments, the locking bar is configured such that torqueing the plug assembly with an unauthorized object applies force to the locking bar without translating such force to the plurality of racks. This type of arrangement enhances torque resistance of the lock cylinder against attempted forced entry.

25 Claims, 4 Drawing Sheets

(56) References Cited

U.S. PATENT DOCUMENTS 2,460,551 A * 2/1949 Swanson ..... E05B 29/00 70/376
2,879,658 A * 3/1959 Johnstone ..... E05B 29/00 70/377
2,949,762 A * 8/1960 Johnstone ..... E05B 29/00 70/495
3,080,744 A * 3/1963 Spain ..... E05B 29/00 70/321
3,597,948 A * 8/1971 Johnstone ..... E05B 29/00 70/406
3,709,006 A * 1/1973 Seidewand ..... E05B 29/00 70/377
4,446,709 A 5/1984 Steinbach
4,485,648 A * 12/1984 Rabinow ..... E05B 29/00 70/419
4,561,270 A * 12/1985 Spreng ..... E05B 17/181 70/377
4,850,210 A 7/1989 Adler
4,966,021 A 10/1990 Boag
5,454,246 A * 10/1995 Mueller ..... E05B 29/00 70/492
5,540,071 A * 7/1996 Reikher ..... E05B 29/00 70/492
5,611,225 A * 3/1997 Resch ..... E05B 17/0062 70/422
5,709,115 A * 1/1998 Richter ..... E05B 17/2084 70/417
5,819,566 A 10/1998 Eden, Jr.
5,956,986 A * 9/1999 Vonlanthen ..... E05B 27/0035 70/492
6,041,631 A * 3/2000 Vonlanthen ..... E05B 29/00 70/413
6,523,381 B1 * 2/2003 Ritz ..... E05B 29/00 70/492
6,860,131 B2 3/2005 Armstrong et al.
6,862,909 B2 3/2005 Armstrong et al.
6,871,520 B2 3/2005 Armstrong et al.
6,951,123 B2 10/2005 Chong et al.
6,959,569 B2 11/2005 Strader et al.
7,100,408 B2 9/2006 Nakasone
7,104,098 B2 9/2006 Romero et al.
7,114,357 B2 10/2006 Armstrong et al.
7,117,701 B2 10/2006 Armstrong et al.
7,308,811 B2 12/2007 Armstrong et al.
7,322,219 B2 1/2008 Armstrong et al.
7,434,431 B2 10/2008 Armstrong et al.
7,565,825 B2 7/2009 Wheatland et al.
7,584,635 B2 * 9/2009 Gan ..... E05B 29/004 70/338
7,634,930 B2 12/2009 Boesel et al.
7,634,931 B2 12/2009 Segien et al.
7,878,036 B2 2/2011 Armstrong et al.
7,900,491 B2 3/2011 Chong
8,033,150 B2 10/2011 Armstrong et al.
8,099,988 B1 1/2012 Wheatland
8,291,735 B1 10/2012 Damikolas
8,316,676 B2 11/2012 Chiang et al.
8,347,678 B2 1/2013 Chong
8,408,080 B2 4/2013 Damikolas
8,424,349 B2 4/2013 Marcelle et al.
8,448,484 B2 5/2013 Huang et al.
8,490,446 B2 7/2013 Rao et al.
8,656,747 B2 2/2014 Armstrong et al.
8,661,863 B2 3/2014 Loreti
8,739,587 B2 6/2014 Chen
8,770,000 B2 7/2014 Loreti
8,881,567 B2 11/2014 Chong et al.
9,127,479 B2 9/2015 Romero et al.
9,359,791 B2 6/2016 Zhang
2003/0037582 A1 * 2/2003 Edwards, Jr. ..... E05B 9/086 70/495
2004/0060333 A1 4/2004 Armstrong et al.
2004/0163433 A1 8/2004 Armstrong et al.
2005/0193786 A1 9/2005 Nakasone
2006/0101880 A1 * 5/2006 Ward-Dolkas ..... E05B 29/004 70/492
2007/0089468 A1 4/2007 Chong et al.
2008/0236224 A1 10/2008 Chong
2008/0271505 A1 11/2008 Armstrong et al.
2009/0277240 A1 11/2009 Huang et al.
2010/0037666 A1 2/2010 Chong
2010/0269602 A1 10/2010 Damikolas
2011/0041579 A1 2/2011 Chen
2012/0031156 A1 2/2012 Wheatland
2012/0247163 A1 10/2012 Damikolas
2013/0086957 A1 4/2013 Emory
2013/0086958 A1 4/2013 Emory
2014/0041429 A1 2/2014 Zhang
2014/0069156 A1 3/2014 Romero et al.
2016/0032618 A1 * 2/2016 Field ..... E05B 27/0082 70/352

* cited by examiner

REKEYABLE LOCK CYLINDER WITH ENHANCED TORQUE RESISTANCE

RELATED APPLICATIONS

This application claims the benefit of U.S. Provisional Application Ser. No. 62/180,339 filed Jun. 16, 2015, which is hereby incorporated by reference in its entirety.

TECHNICAL FIELD

This disclosure relates generally to locks; in particular, this disclosure relates to a lock with a rekeyable lock cylinder having enhanced torque resistance.

BACKGROUND AND SUMMARY

Lock cylinders that can be rekeyed without removal of the cylinder plug are known. For example, U.S. Pat. No. 8,033,150 describes a rekeyable lock cylinder. These types of locks are highly beneficial to consumers because the locks can be easily rekeyed without use of a locksmith.

Although the plug cylinder should freely rotate when an authorized key is inserted into the keyway, the lock cylinder should be configured to resist rotation of the plug when torque is applied by an unauthorized key (or other object). A high amount of torque resistance for the lock cylinder is key to reducing forced entry. Therefore, there is a need for a rekeyable lock with enhanced torque resistance.

According to one aspect, this disclosure provides a rekeyable lock cylinder with a cylinder body and a plug assembly. The cylinder body defines a longitudinal axis and includes a groove. The plug assembly is disposed in the cylinder body and is rotatable about the longitudinal axis. The lock cylinder includes a plurality of key followers and a corresponding plurality of racks disposed in the plug assembly. At least one of the plurality of racks is selectively disengageable from at least one of the plurality of key followers responsive to application of a force by an object inserted into the rekeyable lock cylinder to facilitate rekeying to a new key. The lock cylinder includes means for blocking rotation of the plug assembly with respect to the cylinder body to prevent unlocking of the rekeyable lock cylinder with an unauthorized object. In some embodiments, the blocking means is configured such that torqueing the plug assembly with an unauthorized object applies force to the blocking means without translating such force to the plurality of racks. This type of arrangement enhances torque resistance of the lock cylinder.

In some embodiments, the blocking means includes a locking bar movable transversely with respect to the longitudinal axis between a locked position into the groove of the cylinder body and an unlocked position out of the groove of the cylinder body. For example, the locking bar could include a surface that engages a surface of the groove when in the locked position. In some illustrative embodiments, the respective surfaces of the locking bar and groove that engage when the locking bar is in the locked position are in approximately parallel planes. Depending on the circumstances, the surface of the locking bar that engages the groove in the cylinder body when the locking bar is in the locked position is not a ramped surface. For example, the surfaces could be flat with respect to each other. In some cases, the edge of the locking bar is substantially squared off, such as having an approximately rectangular cross-section.

In some embodiments, there are one or more biasing members urging the locking bar towards the plurality of racks. With this arrangement, the biasing members urge the locking bar out of the groove in the cylinder body when an authorized key is inserted into the keyway. In some illustrative embodiments, a spring force of the biasing member is less than a spring force of the spring-loaded key followers. As such, the spring-loaded key followers will overcome the spring force of the biasing member to lock the lock cylinder when a key is not inserted into the keyway.

Additional features and advantages of the disclosure will become apparent to those skilled in the art upon consideration of the following detailed descriptions exemplifying the best mode of carrying out the disclosure as presently perceived.

BRIEF DESCRIPTION OF THE DRAWINGS

The present disclosure will be described hereafter with reference to the attached drawings which are given as non-limiting examples only, in which.

Corresponding reference characters indicate corresponding parts throughout the several views. The exemplification set out herein illustrates an embodiment of the invention in one form, and such exemplification is not to be construed as limiting the scope of the invention in any manner.

DETAILED DESCRIPTION OF THE DRAWINGS

This disclosure relates to a rekeyable lock cylinder that can be rekeyed without removal of the cylinder plug. The operation for rekeying the lock cylinder is similar to that described in U.S. Pat. No. 8,033,150, which is hereby incorporated by reference. While the rekeying operation operates similarly, the present lock cylinder includes an enhanced torque resistance. In some embodiments, this enhanced torque resistance is configured in a manner that isolates torque on the plug cylinder from the racks, which increases durability of the lock cylinder.

Figure 1:
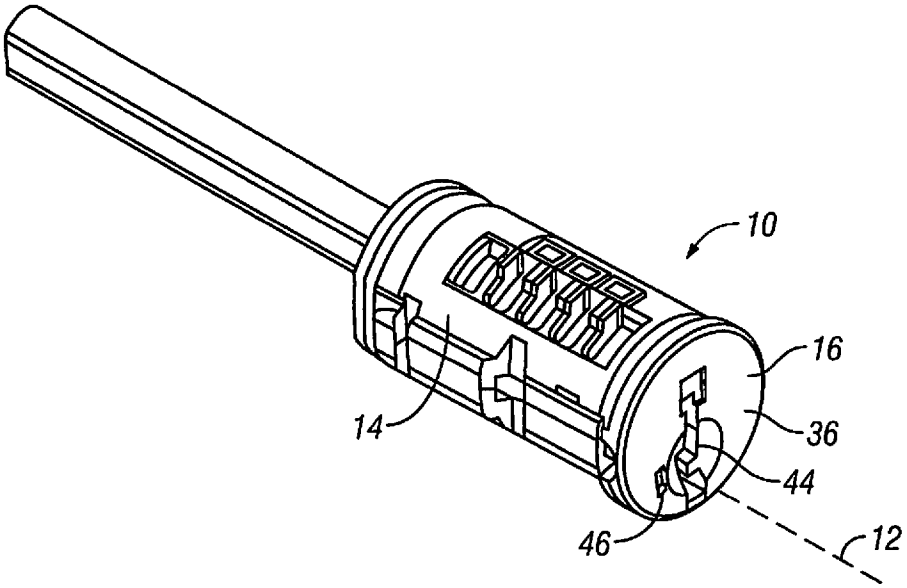
FIG. 1 is a perspective view of an example lock cylinder according to an embodiment of this disclosure.
Figure 2:
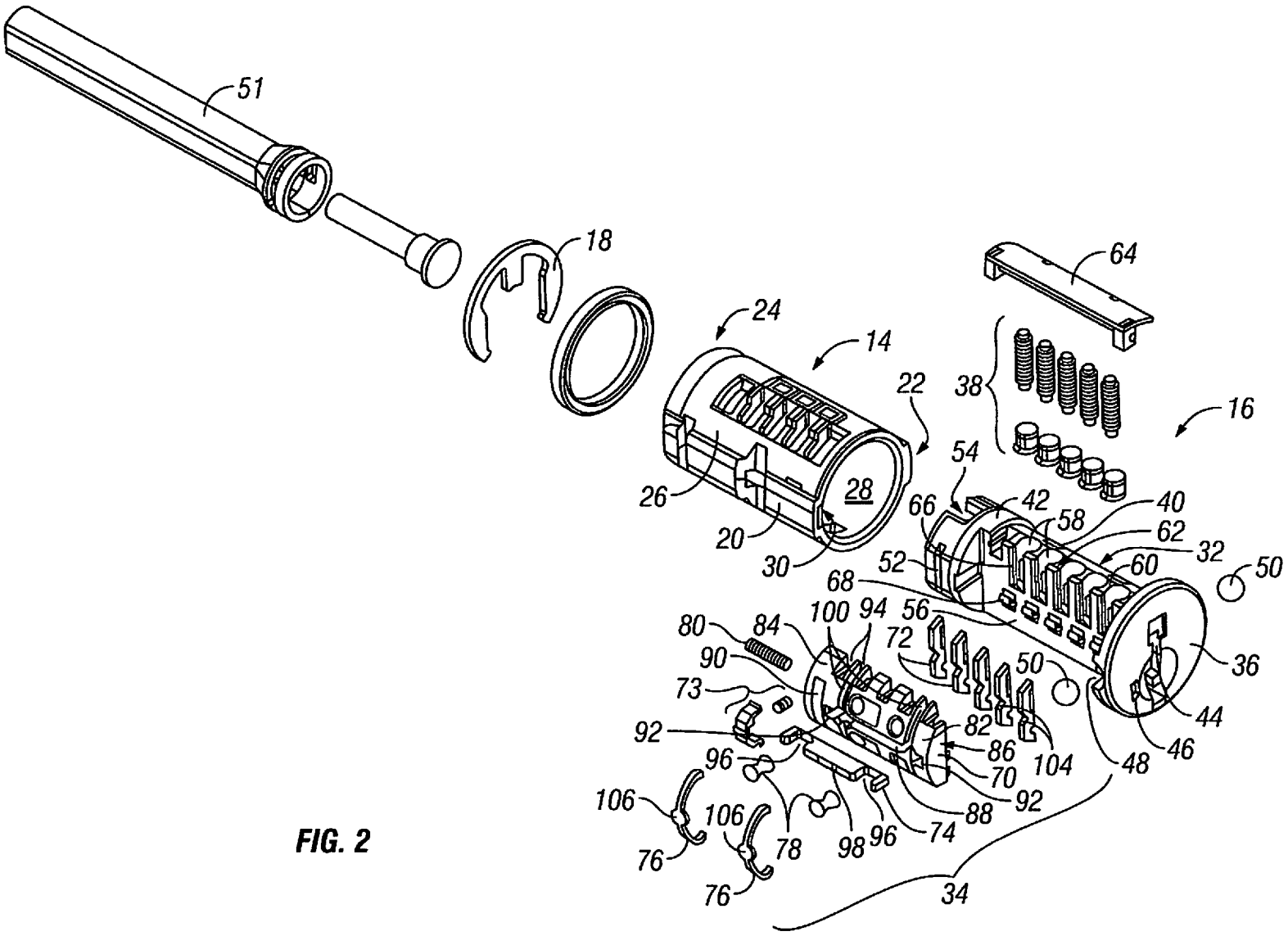
FIG. 2 is an exploded view of the example lock cylinder shown in FIG. 1.

An illustrative lock cylinder 10, according to an embodiment of the present disclosure, is illustrated in FIGS. 1 and 2. The lock cylinder 10 includes a longitudinal axis 12, a cylinder body 14, and a plug assembly 16. A retainer clip 18 (FIG. 2) couples together the cylinder body 14 with the plug assembly 16.

The cylinder body 14, as best seen in FIG. 2, illustratively includes a generally cylindrical body 20 having a front end 22, a back end 24 and a cylinder wall 26 defining an interior surface 28. The cylinder wall 26 includes an interior, locking bar-engaging groove 30 (best seen in FIGS. 4, 5, 6). In some embodiments, the locking bar-engaging groove 30 has a generally rectangular-shaped cross-section and extends longitudinally along a portion of the cylinder body 14, typically from the front end 22.

The plug assembly 16 includes a plug body 32, a carrier subassembly 34 and a plurality of spring-loaded pins 38 (also called key followers). The plug body 32 illustratively includes a plug face 36, an intermediate portion 40 and a drive portion 42. The plug face 36 defines a keyway opening 44, a rekeying tool opening 46, and a pair of channels 48 extending radially outwardly for receiving anti-drilling ball bearings 50. The drive portion 42 is configured to drive a torque blade 51, which could be coupled with a latch assembly (not shown). The drive portion 42 further includes a pair of slots 52 formed in its perimeter and a central groove 54 for receiving the retainer clip 18 to retain the plug body 32 in the cylinder body 14.

The intermediate portion 40 includes a main portion 56 formed as a cylinder section and having a plurality of channels 58 for receiving the spring-loaded pins 38. The channels 58 illustratively extend transversely to the longitudinal axis of the plug body 32. A planar surface 60 defines a recess 62 for receiving a retaining cap 64. The channels 58 extend partially through the plug body 32, with the sidewalls of the channels open to a planar surface 66. The planar surface 66 illustratively includes a plurality of bullet-shaped, rack-engaging features 68.

The carrier subassembly 34 includes a carrier 70, a plurality of racks 72, a spring catch 73, a locking bar 74, a pair of clips 76 for holding corresponding biasing members 78 against the locking bar 74 to urge the locking bar 74 against the racks 72, and a return spring 80. The carrier 70 includes a body 82 in the form of a cylinder section that is complementary to the main portion 56 of the plug body 32, such that the carrier 70 and the main portion 56 combine to form a cylinder that fits inside the cylinder body 14. The carrier 70 includes a curved surface 84 and a flat surface 86. The curved surface 84 includes a locking bar slot 88, a spring catch recess 90, and a pair of clip receiving recesses 100 for receiving the clips 76. The locking bar slot 88 illustratively includes a pair of biasing member-receiving bores 92 for receiving the biasing members 78. In the embodiment shown, the locking bar 74 includes a corresponding pair of recessed areas 96 for receiving the biasing members 78.

Figure 6:
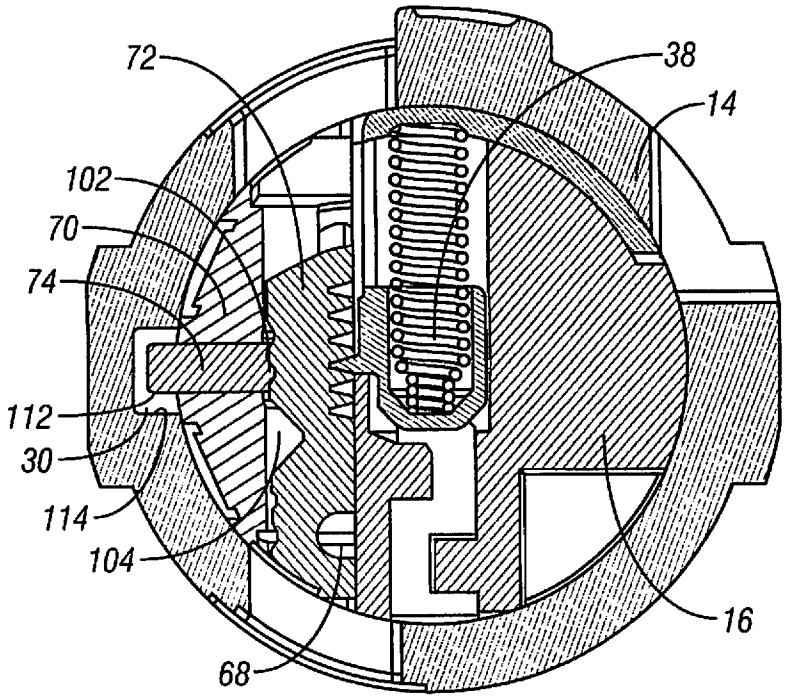
FIG. 6 is a cross-sectional view of the example lock cylinder shown in FIG. 1 showing the interface between the locking bar and cylinder body without a key in the keyway.
Figure 5:
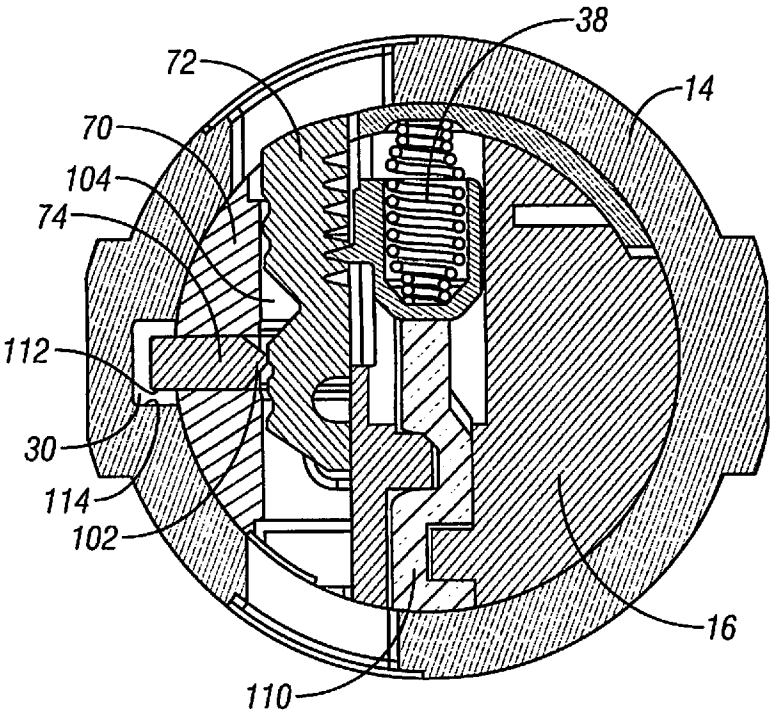
FIG. 5 is a cross-sectional view of the example lock cylinder shown in FIG. 1 showing the interface between the locking bar and cylinder body with an unauthorized key in the keyway.
Figure 4:
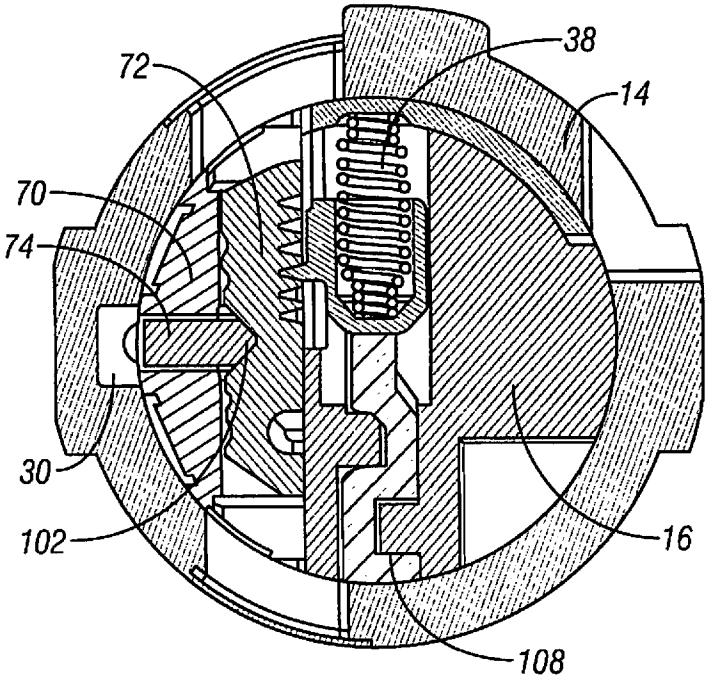
FIG. 4 is a cross-sectional view of the example lock cylinder shown in FIG. 1 showing the interface between the locking bar and cylinder body with an authorized key in the keyway.

The spring-loaded locking bar 74 is sized and configured to fit in the locking bar slot 88 in the carrier 70. The locking bar 74 illustratively includes a blocking portion 98 that is received in the locking bar engaging groove 30 in the cylinder body 14 when in the locked position (FIGS. 5 and 6) and extends out of the locking bar engaging groove 30 when in an unlocked position (FIG. 4). In some embodiments, as illustratively shown, the blocking portion 98 has a squared off edge that forms a rectangular cross-section. This squared-off surface stands in contrast to the triangular-shaped edge of the locking bar described in U.S. Pat. No. 8,033,150, which moves out of the groove in the cylinder body via a camming action. By using the urging of biasing members 78 to move the blocking portion 98 out of the groove 30 in the cylinder body 14, a squared-off edge can be used with a corresponding flat surface in the locking bar engaging groove 30, thereby increasing torque resistance of the lock cylinder 10 compared to a triangular-shaped edge and corresponding triangular-shaped locking bar engaging groove described in U.S. Pat. No. 8,033,150. Moreover, this relieves stress on the racks 72 because torque applied by an unauthorized key (or other object) will not be translated from the locking bar 74 to the racks 72 via a camming action; instead, the locking bar 74 interface with the locking bar engaging groove 30 will isolate the torque from the racks 72. Opposite the squared-off edge of the blocking portion 98, the locking bar 74 includes a flange 102 configured to engage the locking bar-engaging grooves 104 formed in the racks 72 (FIGS. 4, 5, 6). The flat surface 86 of the carrier 70 includes a plurality of parallel rack-receiving slots 94 extending perpendicular to the longitudinal axis of the carrier 70.

Figure 3:
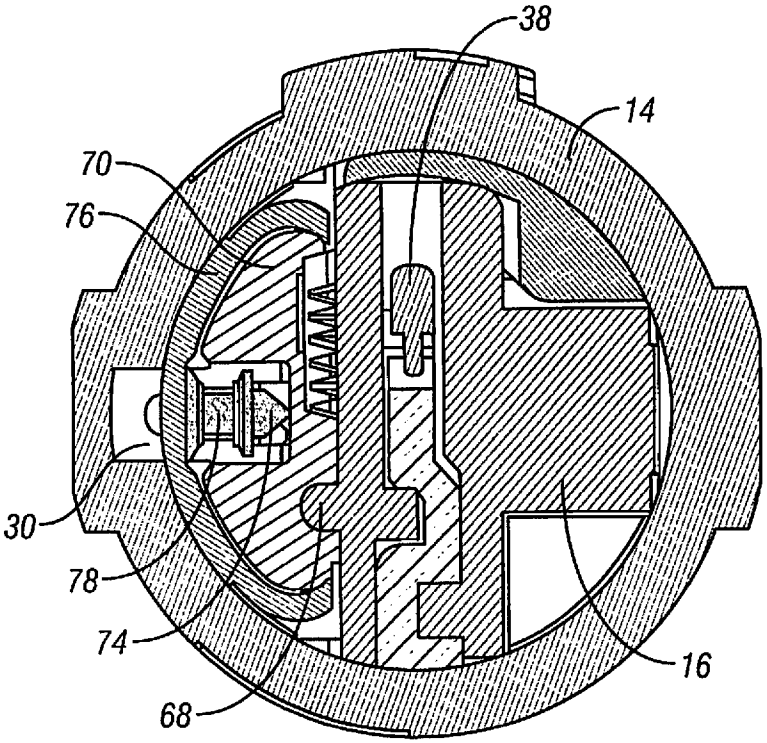
FIG. 3 is a cross-sectional view of the example lock cylinder shown in FIG. 1 showing the springs urging the locking bar towards the racks.

FIG. 3 is an illustrative cross-sectional view of the lock cylinder 10 transversely cut through one of the clips 76. In this view, it can be seen that the clips 76 extend around the carrier 70. One end of the biasing member 78 is fixed against a receiving portion 106 of the clip 76 and the other end is received in the recessed area 96 of the locking bar 74 and urges the locking bar 74 against the racks 72. In this embodiment, the locking bar 74 is continuously urged by the biasing members 78 against the racks 72.

FIGS. 4, 5, and 6 are illustrative cross-sectional views of the lock cylinder 10 transversely cut along the blocking portion 98 of the locking bar 74. In FIG. 4, which shows an authorized key 108 inserted into the keyway opening 44, the key cut of the authorized key 108 is such to move the spring-loaded pins 38 and thereby the racks 72 to a position in which the flange 102 of the locking bar 74 is received into the respective locking bar engaging grooves 104 of the racks 72 via the urging of the biasing members 78. This positions the blocking portion 98 of the locking bar 74 to its unlocking position out of the locking bar engaging groove 30, thereby allowing free rotation of the plug assembly 16 with respect to the cylinder body 14 to unlock the lock cylinder 10. This use of biasing members 78 to urge locking bar 74 out of locking bar engaging groove 30 stands in contrast to the camming action to move locking bar out of a groove in the cylinder body described in U.S. Pat. No. 8,033,150. FIG. 5 illustrates an example in which an unauthorized key 110 is inserted into the keyway opening 44. Since the key cut of the unauthorized key 110 is "unauthorized," the locking bar engaging groove 104 of at least one of the racks 72 is not aligned with the flange 102 of the locking bar 74. As such, the locking bar 104 cannot be urged out of the locking bar engaging groove 30 of the cylinder body 14, which means the blocking portion 98 prevents rotation of the plug assembly 16 with respect to the cylinder body 14. In the embodiment shown, the edge of the blocking portion 98 is squared-off and the locking bar engaging groove 30 of the cylinder body 14 has a corresponding shape. This means that the force caused by torqueing the plug assembly 16 with respect to the cylinder body 14 will be applied to the flat surface 112 of the blocking portion 98 with respect to a flat interior surface 114 of the locking bar engaging groove 30. Since the surfaces 112, 114 are flat with respect to each other, this enhances torque resistance compared to a ramped surface, such as the triangular edge of the locking bar and corresponding triangular groove in the cylinder body of U.S. Pat. No. 8,033,150. Moreover, unlike the flat surfaces 112, 114, the ramped surfaces described in U.S. Pat. No. 8,033,150 creates a camming action that applies force to the racks, which in some cases can deform the racks, or otherwise reduce durability of the racks. FIG. 6 illustrates an example in which there is no key in the lock cylinder 10. The springs of the spring-loaded pins 38 have a higher spring force than the biasing members 78. Accordingly, without a key in the keyway, the spring-loaded pins 38 drive the racks 72 downward, overcoming the force of biasing members 78, so that the flange 102 of the locking bar 74 is not received in the locking bar engaging grooves 104 of the racks 74. This forces the blocking portion 98 of the locking bar 74 into the locking bar engaging groove 30 of the cylinder body 14, which prevents rotation of the plug assembly 16 with respect to the cylinder body 14.

EXAMPLES

Illustrative examples of the rekeyable lock cylinder disclosed herein are provided below. An embodiment of the rekeyable lock cylinder may include any one or more, and any combination of, the examples described below.

Example 1 is a rekeyable lock cylinder with a cylinder body having a longitudinal axis and including a groove. The lock cylinder includes a plug assembly disposed in the cylinder body that is rotatable about the longitudinal axis. A plurality of key followers with a corresponding plurality of racks are disposed in the plug assembly. At least one of the plurality of racks is selectively disengageable from at least one of the plurality of key followers responsive to application of a force by an object inserted into the rekeyable lock cylinder to facilitate rekeying to a new key. The lock cylinder includes means for blocking rotation of the plug assembly with respect to the cylinder body to prevent unlocking of the rekeyable lock cylinder with an unauthorized object. The blocking means is configured such that force from torqueing the plug assembly with an unauthorized object is primarily distributed between the cylinder body and blocking means compared with any force translated to the plurality of racks, thereby enhancing torque resistance of the rekeyable lock cylinder.

In Example 2, the subject matter of Example 1 is further configured such that the blocking means comprises at least one locking bar movable transversely with respect to the longitudinal axis between a locked position into the groove of the cylinder body and an unlocked position out of the groove of the cylinder body.

In Example 3, the subject matter of Example 2 is further configured such that the at least one locking bar includes a surface that engages a surface of the groove when in the locked position. The respective surfaces of the at least one locking bar and groove engage when the at least one locking bar is in the locked position are in approximately parallel planes.

In Example 4, the subject matter of Example 3 is further configured such that the surface of the at least one locking bar that engages the groove in the cylinder body when the at least one locking bar is in the locked position is not a ramped surface.

In Example 5, the subject matter of Example 3 is further configured such that the surface of the at least one locking bar that engages the groove in the cylinder body when the at least one locking bar is in the locked position is a flat surface.

In Example 6, the subject matter of Example 3 is further configured such that the surface of the at least one locking bar that engages the groove in the cylinder body is in a plane that is approximately parallel to an axis radial to the longitudinal axis.

In Example 7, the subject matter of Example 2 is further configured such that an edge of the at least one locking bar is received in the groove of the cylinder body when in the locked position.

In Example 8, the subject matter of Example 7 is further configured such that the edge of the at least one locking bar is substantially squared off.

In Example 9, the subject matter of Example 7 is further configured such that the edge of the at least one locking bar has an approximately rectangular cross-section.

In Example 10, the subject matter of Example 1 is further configured to include a biasing member urging the blocking means towards the plurality of racks.

In Example 11, the subject matter of Example 10 is further configured such that the plurality of key followers are spring-loaded and wherein a spring force of the biasing member is proportional to a spring force of the spring-loaded key followers to ensure any key follower will not be lifted by the at least one locking bar.

Example 12 is a rekeyable lock cylinder including a cylinder body with a longitudinal axis including a groove. The lock cylinder includes a plug assembly disposed in the cylinder body and being rotatable about the longitudinal axis. A carrier assembly is provided that includes a plurality of racks and at least one locking bar. The lock cylinder includes a plurality of key followers disposed in the plug assembly. At least one of the plurality of racks is selectively disengageable from at least one of the plurality of key followers responsive to application of a force by an object inserted into the rekeyable lock cylinder to facilitate rekeying to a new key. The at least one locking bar is movable transverse to, and rotationally about the longitudinal axis. At least a portion of the at least one locking bar is movable between a locked position in the groove of the cylinder body and an unlocked position out of the groove in the cylinder body. The at least one locking bar is configured to prevent unlocking of the rekeyable lock cylinder with an unauthorized object. The at least one locking bar is configured such that force from torqueing the plug assembly with an unauthorized object is primarily distributed between the cylinder body and carrier assembly compared to any force translated to the plurality of racks.

In Example 13, the subject matter of Example 12 is further configured such that a biasing member urges the at least one locking bar towards the plurality of racks.

In Example 14, the subject matter of Example 12 is further configured such that the plurality of key followers are spring-loaded and a spring force of the biasing member is less than a spring force of the spring-loaded key followers.

Example 15 is a rekeyable lock cylinder that includes a cylinder body with a longitudinal axis including a groove. A plug assembly is disposed in the cylinder body and is rotatable about the longitudinal axis. The lock cylinder includes a plurality of key followers and a corresponding plurality of racks disposed in the plug assembly. At least one of the plurality of racks is selectively disengageable from at least one of the plurality of key followers responsive to application of a force by an object inserted into the rekeyable lock cylinder to facilitate rekeying to a new key. At least one locking bar is movable transverse to, and rotationally about the longitudinal axis. At least a portion of the at least one locking bar is movable between a locked position in the groove of the cylinder body and an unlocked position out of the groove in the cylinder body. The portion of the at least one locking bar is received into the groove has an approximately rectangular cross-section. The lock cylinder includes a biasing member that urges the at least one locking bar towards the plurality of racks.

In Example 16, the subject matter of Example 15 is further configured such that the plurality of key followers are spring-loaded and a spring force of the biasing member is less than a spring force of the spring-loaded key followers.

Although the present disclosure has been described with reference to particular means, materials, and embodiments, from the foregoing description, one skilled in the art can easily ascertain the essential characteristics of the invention and various changes and modifications may be made to adapt the various uses and characteristics without departing from the spirit and scope of the invention.

What is claimed is:

1. A rekeyable lock cylinder comprising:

a cylinder body with a longitudinal axis and including a groove;

a plug assembly disposed in the cylinder body and being rotatable about the longitudinal axis;

a plurality of key followers and a corresponding plurality of racks disposed in the plug assembly, wherein at least one of the plurality of racks is selectively disengageable at a first side from at least one of the plurality of key followers responsive to application of a force by an object inserted into the rekeyable lock cylinder to facilitate rekeying to a new key, at least one of the plurality of key followers including a projection and at least one of the plurality of racks including a plurality of projection receiving recesses at the first side to receive the projection, each projection receiving recess being separated by a projection receiving recess distance measured between bottom-most portions of immediately adjacent projection receiving recesses;

wherein at least one of the plurality of racks includes an engaging groove at a second side, opposite the first side, the engaging groove including a pair of locking bar engaging surfaces each extending toward one another from the second side of the at least one of the plurality of racks, wherein the locking bar engaging surfaces intersect with the second side of the at least one of the plurality of racks to define a pair of engaging groove opening edges that, between them, define a groove height, wherein the locking bar engaging surfaces intersect with one another as they extend toward the first side of the at least one of the plurality of racks to form a bottom-most portion, wherein a portion of the groove height measured from either engaging groove opening edge and the bottom-most portion of the engaging groove, in a direction in which the at least one of the plurality of racks travels within the plug assembly, is greater than the projection receiving recess distance;

a locking bar for blocking rotation of the plug assembly with respect to the cylinder body to prevent unlocking of the rekeyable lock cylinder with an unauthorized object, wherein the locking bar includes a flange, the flange being defined by a pair of ramped surfaces extending toward one another from opposite sides of the locking bar, wherein the locking bar is movable transversely with respect to the longitudinal axis between a locked position, in which at least a portion of the locking bar is positioned within the groove of the cylinder body, and an unlocked position in which the locking bar is positioned out of the groove of the cylinder body, and wherein, when the locking bar of the plug assembly is in the unlocked position, the ramped surfaces of the flange are positioned entirely within the engaging groove of the at least one of the plurality of racks;

a biasing member urging the locking bar towards the plurality of racks, wherein the locking bar is configured such that force from torqueing the plug assembly with an unauthorized object is primarily distributed between the cylinder body and the locking bar as compared with any force translated to the plurality of racks without applying a force transverse to the longitudinal axis of the cylinder body, thereby enhancing torque resistance of the rekeyable lock cylinder.

2. The rekeyable lock cylinder of claim 1, wherein the locking bar includes a surface that engages a surface of the groove of the cylinder body when in the locked position, wherein the respective surfaces of the locking bar and groove of the cylinder body that engage when the locking bar is in the locked position are in approximately parallel planes.

3. The rekeyable lock cylinder of claim 2, wherein the surface of the locking bar that engages the groove in the cylinder body when the locking bar is in the locked position is not a ramped surface.

4. The rekeyable lock cylinder of claim 2, wherein the surface of the locking bar that engages the groove in the cylinder body when the locking bar is in the locked position is a flat surface.

5. The rekeyable lock cylinder of claim 2, wherein the surface of the locking bar that engages the groove in the cylinder body is in a plane that is approximately parallel to an axis radial to the longitudinal axis.

6. The rekeyable lock cylinder of claim 1, wherein an edge of the locking bar is received in the groove of the cylinder body when in the locked position.

7. The rekeyable lock cylinder of claim 6, wherein the edge of the locking bar is substantially squared off.

8. The rekeyable lock cylinder of claim 6, wherein the edge of the locking bar has an approximately rectangular cross-section.

9. A rekeyable lock cylinder comprising:

a cylinder body with a longitudinal axis including a groove;

a plug assembly disposed in the cylinder body and being rotatable about the longitudinal axis;

a carrier assembly including a plurality of racks and a locking bar;

a plurality of key followers disposed in the plug assembly, wherein at least one of the plurality of racks is selectively disengageable from at least one of the plurality of key followers responsive to application of a force by an object inserted into the rekeyable lock cylinder to facilitate rekeying to a new key, the at least one of the plurality of key followers including a rack engaging feature, the rack engaging feature being at least one of a projection and a recess, wherein the at least one of the plurality of racks includes a plurality of key follower engaging features at a first side, wherein the plurality of key follower engaging features are a plurality of the corresponding at least one of the recess and the projection of the at least one of the plurality of key followers, each key follower engaging feature being separated by a key follower receiving distance measured between centers of immediately adjacent key follower engaging features, wherein the locking bar is movable transverse to, and rotationally about the longitudinal axis, wherein at least a portion of the locking bar is movable between a locked position in the groove of the cylinder body and an unlocked position out of the groove in the cylinder body;

wherein the at least one of the plurality of racks includes a locking bar engaging groove at a second side, opposite the first side, wherein the locking bar engaging groove has a bottom-most portion and two groove opening edges, wherein a height from the bottom-most portion to either of the groove opening edges, measured in a direction in which the at least one of the plurality of racks moves within a plug body, is greater than the key follower receiving distance, and wherein the locking bar is configured to prevent unlocking of the rekeyable lock cylinder with an unauthorized object, wherein the locking bar is configured such that force from torqueing the plug assembly with an unauthorized object is primarily distributed between the cylinder body and the locking bar as compared to any force translated to the plurality of racks without applying a force toward the longitudinal axis of the cylinder body.

10. The rekeyable lock cylinder of claim 9, further comprising a biasing member urging the locking bar towards the plurality of racks.

11. The rekeyable lock cylinder of claim 10, wherein the plurality of key followers are spring-loaded and wherein a spring force of the biasing member is less than a spring force of the spring-loaded key followers.

12. The rekeyable lock cylinder of claim 9, wherein the locking bar includes a flange defined by a pair of ramped surfaces extending toward one another from opposite sides of the locking bar, wherein, when in the unlocked position, the entire flange of the locking bar is positioned within the locking bar engaging groove of the at least one of the plurality of racks.

13. The rekeyable lock cylinder of claim 12, wherein the locking bar engaging groove includes a pair of locking bar engaging surfaces, wherein the locking bar engaging surfaces are separated furthest from one another at a complete groove height, wherein the ramped surfaces of the flange of the locking bar are separated furthest from one another at a flange height, and wherein the complete groove height is greater than the flange height defined by where the ramped surfaces are separated furthest from one another.

14. The rekeyable lock cylinder of claim 9, wherein the locking bar engaging groove has a groove height and the locking bar has a locking bar height, wherein the groove height is greater than the locking bar height.

15. The rekeyable lock cylinder of claim 9, wherein the locking bar engaging groove includes a pair of locking bar engaging surfaces each extending toward one another from the second side of the at least one of the plurality of racks toward the first side, wherein the locking bar engaging groove has a depth defined by the locking bar engaging surfaces, wherein the depth is measured in the same direction as the movement of the locking bar, wherein the locking bar includes a triangular flange defined by a pair of ramped surfaces, wherein the pair of ramped surfaces each extend toward one another from opposite sides of the locking bar, wherein the ramped surfaces define a flange depth measured in the same direction as the movement of the locking bar, wherein the depth of the flange is less than the depth of the locking bar engaging groove.

16. The rekeyable lock cylinder of claim 9, wherein the locking bar includes a flange, wherein, when in the unlocked position, the entire flange is positioned within the locking bar engaging groove of the at least one of the plurality of racks.

17. The rekeyable lock cylinder of claim 9, wherein the locking bar includes a top and a bottom surface, wherein, when in the unlocked position, at least a portion of the top and bottom surfaces of the locking bar are positioned within the locking bar engaging groove.

18. A rekeyable lock cylinder comprising:

a cylinder body with a longitudinal axis including a groove;

a plug assembly disposed in the cylinder body and being rotatable about the longitudinal axis;

a plurality of key followers and a corresponding plurality of racks disposed in the plug assembly, wherein at least one of the plurality of racks is selectively disengageable from at least one of the plurality of key followers responsive to application of a force by an object inserted into the rekeyable lock cylinder to facilitate rekeying to a new key, the at least one of the plurality of key followers including a rack engaging feature, the rack engaging feature being at least one of a projection and a recess, wherein the at least one of the plurality of racks includes a plurality of key follower engaging features at a first side, wherein the plurality of key follower engaging features are a plurality of the corresponding at least one of the recess and the projection of the at least one of the plurality of key followers, each key follower engaging feature being separated by a key follower receiving distance measured between centers of immediately adjacent key follower engaging features;

a locking bar movable transverse to, and rotationally about the longitudinal axis, wherein at least a portion of the locking bar is movable between a locked position in the groove of the cylinder body and an unlocked position out of the groove of the cylinder body;

wherein the at least one of the plurality of racks includes a locking bar engaging groove at a second side, opposite the first side, wherein the locking bar engaging groove has a bottom-most portion and two groove opening edges, wherein a height from the bottom-most portion to either of the groove opening edges, measured normal to the movement of the locking bar, is greater than the key follower receiving distance, wherein the at least a portion of the locking bar received into the groove of the cylinder body has an approximately rectangular cross-section; and a biasing member continuously urging the locking bar towards the plurality of racks.

19. The rekeyable lock cylinder of claim 18, wherein the plurality of key followers are spring-loaded and wherein a spring force of the biasing member is less than a spring force of the spring-loaded key followers.

20. The rekeyable lock cylinder of claim 18, wherein the locking bar engaging groove has a groove height and the locking bar has a locking bar height, wherein the groove height is greater than the locking bar height.

21. The rekeyable lock cylinder of claim 20, wherein the locking bar includes a surface that engages a surface of the groove of the cylinder body when in the locked position, wherein the respective surfaces of the locking bar and groove of the cylinder body that engage when the locking bar is in the locked position are in approximately parallel planes.

22. The rekeyable lock cylinder of claim 18, wherein the locking bar includes a top and a bottom surface, wherein, when in the unlocked position, at least a portion of the top and bottom surfaces of the locking bar are positioned within the locking bar engaging groove.

23. A rekeyable lock cylinder comprising:

a cylinder body with a longitudinal axis including a groove; and a plug assembly comprising:

a plug body;

a carrier;

a plurality of key followers received in the plug body, at least one of the plurality of key followers including a rack engaging feature, the rack engaging feature being at least one of a projection and a recess;

a corresponding plurality of racks received in the carrier and configured to engage with the plurality of key followers, wherein at least one of the plurality of racks is selectively disengageable at a first side from the at least one of the plurality of key followers, wherein the at least one of the plurality of racks includes a plurality of key follower engaging features at a first side, wherein the plurality of key follower engaging features are a plurality of the corresponding at least one of the recess and the projection of the at least one of the plurality of key followers, each key follower engaging feature being separated by a key follower receiving distance measured between centers of immediately adjacent key follower engaging features, wherein the at least one of the plurality of racks includes a locking bar engaging groove at a second side, opposite the first side, wherein the locking bar engaging groove has a bottom-most portion and two groove opening edges, wherein a height from the bottom-most portion to either of the groove opening edges, measured normal to the movement of the locking bar, is greater than the key follower receiving distance, a locking bar received in the carrier and configured to engage with the racks, the locking bar formed to include a recessed area;

a biasing member received in the recessed area of the locking bar; and a clip engaged with the carrier and biasing member to bias the locking bar toward the plurality of racks, wherein the plug assembly is disposed in the cylinder body and rotatable about the longitudinal axis, the carrier is movable relative to the plug body along the longitudinal axis, and the locking bar is movable between a locked position where at least a portion of the locking bar is received in the groove of the cylinder body and an unlocked position where the locking bar is displaced from the groove in the cylinder body.

24. The rekeyable lock cylinder of claim 23, wherein the carrier is formed to include a clip receiving recess, wherein the clip is arcuate and engaged with the clip receiving recess of the carrier, and wherein the clip is formed to define a receiving portion aligned with the biasing member and recessed area of the locking bar.

25. A rekeyable lock cylinder comprising:

a cylinder body with a longitudinal axis including a groove; and a plug assembly comprising:

a plug body;

a carrier, the carrier formed to include a clip receiving recess;

a plurality of key followers received in the plug body, at least one of the plurality of key followers including a rack engaging feature, the rack engaging feature being at least one of a projection and a recess;

a corresponding plurality of racks received in the carrier and configured to engage with the plurality of key followers, wherein at least one of the plurality of racks is selectively disengageable at a first side from the at least one of the plurality of key followers, wherein the at least one of the plurality of racks includes a plurality of key follower engaging features at the first side, wherein the plurality of key follower engaging features are a plurality of the corresponding at least one of the recess and the projection of the at least one of the plurality of key followers, each key follower engaging feature being separated by a key follower receiving distance measured between centers of immediately adjacent key follower engaging features, wherein the at least one of the plurality of racks includes a locking bar engaging groove at a second side, opposite the first side, wherein the locking bar engaging groove has a bottom-most portion and two groove opening edges, wherein a height from the bottom-most portion to either of the groove opening edges, measured normal to the movement of the locking bar, is greater than the key follower receiving distance;

a locking bar received in the carrier and configured to engage with the plurality of racks;

a biasing member engaged with the locking bar; and a clip engaged with the clip receiving recess of the carrier and engaged with the biasing member to bias the locking bar toward the plurality of racks, wherein the plug assembly is disposed in the cylinder body and rotatable about the longitudinal axis, the carrier is movable relative to the plug body along the longitudinal axis, and the locking bar is movable between a locked position where at least a portion of the locking bar is received in the groove of the cylinder body and an unlocked position where the locking bar is displaced from the groove in the cylinder body.

* * * * *